United States Patent [19]

Kurauchi et al.

[11] Patent Number: 4,590,724

[45] Date of Patent: May 27, 1986

[54] ANCHORAGE FOR STEEL WIRE STRAND FOR PRESTRESSED CONCRETE

[75] Inventors: Makoto Kurauchi, Nishinomiya; Takeshi Kobayashi, Kobe; Masakazu Izumi, Ikoma; Jiro Aota, Akashi, all of Japan

[73] Assignee: Shinko Kosen Kogyo Kabushiki Kaisha, Amagasaki, Japan

[21] Appl. No.: 489,345

[22] Filed: Apr. 28, 1983

[51] Int. Cl.[4] ..... E04C 3/10

[52] U.S. Cl. ..... 52/223 L; 52/230; 52/228

[58] Field of Search ..... 52/223, 230, 223 L, 52/227, 228; 29/517

[56] References Cited

U.S. PATENT DOCUMENTS 4,192,114 3/1980 Jungwirth et al. ..... 52/223 L X

FOREIGN PATENT DOCUMENTS 1082394 5/1960 Fed. Rep. of Germany .... 52/223 L
2241933 3/1974 Fed. Rep. of Germany .... 52/223 L
628886 11/1961 Italy ..... 52/223 L

*Primary Examiner*—Carl O. Friedman
*Assistant Examiner*—Naoko N. Slack
*Attorney, Agent, or Firm*—Oblon, Fisher, Spivak, McClelland & Maier

[57] ABSTRACT

An anchorage for PC wire strands, anchorage having an enlarged head portion formed by heading a terminal end of a PC wire strand, and an anchoring member held in pressure contact with a portion of the PC wire strand in a position near the terminal end and having a side end held in close contact with the enlarged head portion, the anchoring member being so formed as to have a length corresponding to one third or one half of the length required for anchoring the PC wire strand by the anchoring member alone.

4 Claims, 10 Drawing Figures

ANCHORAGE FOR STEEL WIRE STRAND FOR PRESTRESSED CONCRETE

BACKGROUND OF THE INVENTION

1. Field of the Invention

The present invention relates to an anchorage for a steel wire strand for prestressed concrete (hereinafter referred to as PC wire strand) suitable for prestressed concrete members or members of a staycable wherein an anchoring means is used in an embedded state.

2. Description of the Prior Art

Heretofore, in a prestressed concrete member wherein an anchoring means is used in an embedded state and not used repeatedly, for example, in post-tensioned concrete member or in a centrifugally processed pretension prestressed concrete pile (hereinafter referred to as PC pile) or the like, there has been used a steel wire or bar as steel material for prestressed concrete (hereinafter referred to as PC steel material), an end portion of which is subjected to heading at a warm (100°-500° C.) or cold region to form an enlarged anchor portion permitting an embedded use of the steel wire or bar. However, the recent tendency to enhancement of strength of the aforementioned pile or the like has given rise to an increasing demand for a PC steel material of larger diameter and of higher strength. In this case, wire for prestressed concrete (hereinafter referred to as PC wire) encounters a limit as to the enlargement of its diameter and enhancement of its strength, and the PC steel bar also encounters a limit as to the enhancement of its strength. On the other hand, PC wire strands can easily be thickened in diameter and strengthened and are superior with respect to economy, so their application to the foregoing pile or the like is now in demand. However, the fact is that as an anchoring means for an end portion of PC wire strands there has not yet been developed a structure which is inexpensive and compact.

More particularly, the PC wire strand usually is anchored by means such as an anchoring member in the form of a chuck or a compression grip, but these anchor fittings are expensive and large-sized. It has also been tried to apply the foregoing heading anchor method to the PC wire strand, but this has not been practically used yet because in this case the resultant enlarged head portion is deficient in strength with a breaking strength that is 40 to 60% of the breaking strength of the PC wire strand.

Further, the PC wire strand is also anchored by means of a combination of forming the end portion of the PC wire strand into an enlarged head and clamping an adjacent portion of said PC wire strand by wedges as shown in U.S. Pat. No. 3,820,832. However, in this kind of anchoring means, the tension or the stress force of the PC wire strand is undertaken by the wedge anchor only and the enlarged head of PC wire strand assists in transmitting said force to the wedges. Therefore, such an anchor fitting is large-sized and expensive for embedded use. Another function of the enlarged head of PC wire strand in this invention is the prevention of undesired slippage of the strand in the wedges and ejection of the wedges from the anchor sleeve by jerky movements.

SUMMARY OF THE INVENTION

The present invention, which has been effected in view of the above-mentioned circumstances, provides an anchoring structure for PC wire strands having a sufficient strength matching the breaking strength of those strands and which, being small-sized, is suitable for embedded use and is superior in economy.

More specifically, on the basis of experimental data as will be referred to hereinbelow the present inventor has found that if an anchor portion comprising a combination of an anchoring member and an enlarged head portion is provided on the PC wire strand and about two-thirds of a breaking force is undertaken by the anchoring member and the remainder by the enlarged head portion, then the anchoring member can be shortened to one third to one half while attaining a 100% anchoring efficiency. On the basis of this finding the present inventors have accomplished the present invention.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DETAILED DESCRIPTION OF THE PREFERRED EMBODIMENTS

Figure 2:
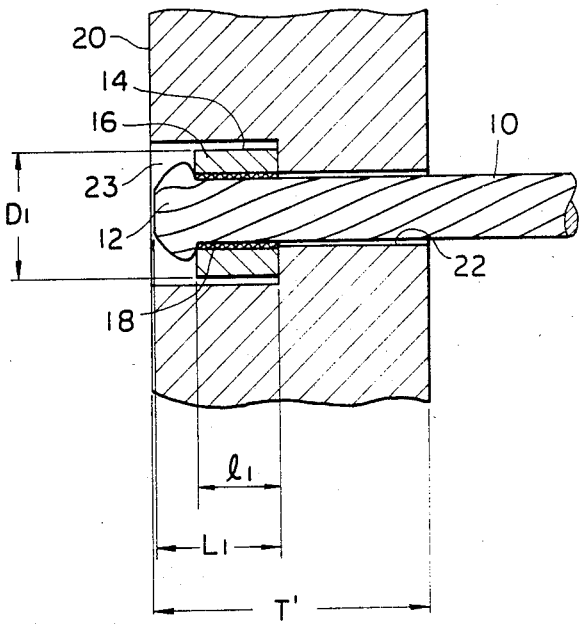
FIG. 2 is a sectional view of an anchorage according to an embodiment of the present invention.

Referring to FIG. 2, there is shown an embodiment of the anchorage of the present invention, in which the reference numeral 10 denotes a PC wire strand, numeral 12 denotes on enlarged head portion formed by heading, and numeral 14 denotes a compression grip (anchor fitting) held in pressure contact with the PC wire strand 10. The compression grip as referred to herein comprises a sleeve for pressure contact with the PC wire strand 10 to form an anchor portion. In the figure, the compression grip 14 includes a sleeve 16 and a wire coil 18 of a triangular cross section serving as a friction enhancing material. The triangular wire coil 18 is interposed between the PC wire strand 10 and the sleeve 16, and in this state the sleeve 16 is brought into pressure contact with the PC wire strand 10 to form an integral body. Considering, however, that the friction enhancing material is not limited to the above triangular wire coil 18; there may be used any other suitable friction enhancing material, e.g. carborundum, or alternatively the PC wire strand 10 itself may be endowed with a friction enhancing action by a slight threading or other means.

The length of the compression grip 14 is set at one half to one third of the length required for anchoring with the compression grip alone and the enlarged head portion 12 is brought into a close contact with a side end of the compression grip 14 to form a terminal end of the PC wire strand 10. Numeral 20 denotes a bearing plate, numeral 22 denotes an anchoring hole formed in the bearing plate and numeral 23 indicates an enlarged space formed in the bearing plate.

Figure 3:
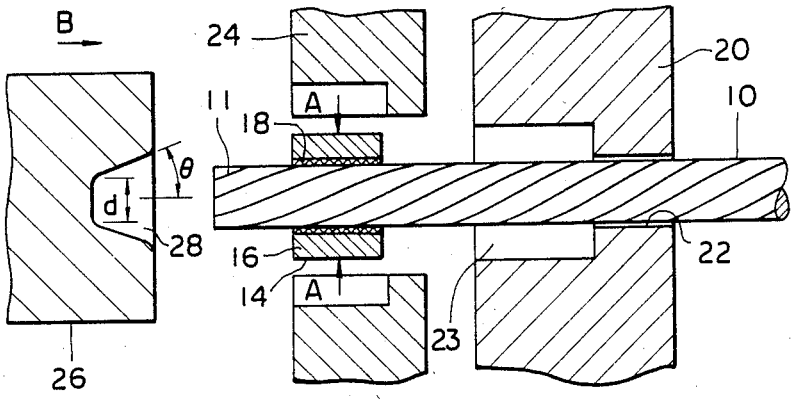
FIG. 3 is a sectional view showing an example of a method for obtaining the anchorage of FIG. 2.

An example of a method for obtaining this anchoring structure will now be described with reference to FIG. 3. This figure shows a state before pressure bonding of the compression grip 14 and before heading, in which the PC wire strand 10 has already been inserted through the anchoring hole 22 of the bearing plate 20. Over the outer periphery of an end portion 11 of the PC wire strand in a position leaving an extra length (one to two times the diameter of the PC wire strand) sufficient to perform heading are disposed a friction enhancing material such as the triangular wire coil 18 and the sleeve 16, and the sleeve 16 is then brought into pressure contact with the PC wire strand 10 as shown in arrow "A" by compressing, swaging or other suitable means. In this case, compressing of the sleeve 16 may be done by a chucking die 24 of a heading machine for the formation of an enlarged head portion, whereby it is possible to let the above die fulfill both compressing and chucking functions simultaneously. Simultaneous with this pressure bonding operation, heading is accomplished for the end portion of the PC wire strand 10 by means of a heading die 26 of the heading machine to form the enlarged head portion 12. In this manner, there is obtained an anchor portion wherein the enlarged head portion 12 and the compression grip 14 are in close contact and integral with each other. Thereafter, the PC wire strand 1 is tensioned to the required load by a jack or other tensioning machines and anchored at the bearing plate 20.

As the method of forming the end portion of PC wire strand into the enlarged head, the ordinary method of cold heading can be applied but it is preferred to do forming at a warm temperature between 100° C. and 900° C., preferably between 500° C. and 900° C. In this case, the PC wire strand is heated by means of sending an electric current between the chucking die 24 and the heading die 26. Other methods may also be applied. According to experiments the shape of the enlarged head formed at a temperature between 500° C. and 900° C. was satisfactory. If ordinary cold heading is practiced, satisfactory forming of the enlarged head cannot be gained due to the fact that wires forming the PC wire strand have stiffness and lie with a certain twist angle against the direction of heading, and thus each wire is scattered from the remaining wires when it is pressed by the heading die 26. Therefore, it is preferable to heat the end of PC wire strand 10 to a temperature between 500° C. and 900° C. to ease resistance to deformation as much as possible, and also to make the shape of the recess 28 of the heading die 26 a truncated cone as shown in FIG. 3 and to make the diameter d of the bottom of the recess 28 one half to three fourths of the diameter of the PC wire strand to thereby bind each wire at the recess 28.

Figure 4:
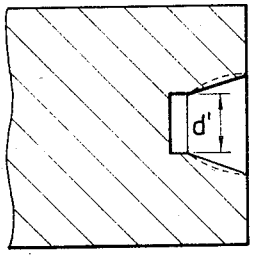
FIG. 4 is a enlarged detailed view of the heading die 10 shown in FIG. 3.

As another method of binding each wire, the bottom of the recess 28 of the heading die 26 may be cylindrically shaped with its diameter d' kept about the same as that of the PC wire strand 10 as shown in FIG. 4. Of course, it is possible to shape the recess 28 of the heading die 26 like a spherical surface in order to form the enlarged head of PC wire strand 10. Our experiments have shown that formation of the enlarged head is possible by keeping the angle $\theta$ of the inner tapered surface of the recess 28 between 10° and 30°, and by keeping such angle around 20° the most satisfactory result could be gained both in terms of the shape of the enlarged head and anchoring efficiency.

According to the above method, moreover, since in the heading operation the inside portion of the head is received not by the chucking die 24 but by the sleeve 16 which is softer than the chucking die 24, an affinity is created between the wires of the PC wire strand and the sleeve 16, whereby deterioration of strength caused by buckling of the PC strand wires at the inside neck portion of the head can be reduced. Such a secondary effect is also attained.

In this anchoring structure, as previously noted, the length of the compression grip 14 is set at one half to one third of the length required for anchoring with the compression grip 14 alone, and this numerical limitation is based on the following experimental data.

Figure 5:
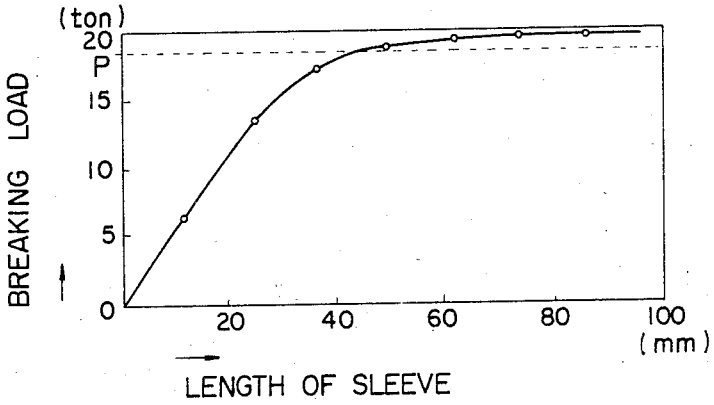
FIG. 5 is a graph showing the relationship between the sleeve length of a compression grip and a breaking load.

In case an enlarged head portion is formed on the PC wire strand 10 by means of the heading, the anchoring efficiency of the enlarged head portion (i.e. the ratio of anchoring strength to the breaking strength of the PC wire strand) is about 40% to about 60%. Therefore, in order to let the compression grip 14 and the enlarged head portion 12 receive a partial charge of the breaking force, it is preferable, when instability in the above-mentioned range of the anchoring efficiency of the enlarged head portion 12 is taken into account, that about two thirds of the breaking force be undertaken by the compression grip 14 and the remainder by the enlarged head portion 12. On the other hand, according to the results of an anchoring efficiency test, the relation between the sleeve length of the compression grip 14 and the breaking load is as shown in the graph of FIG. 5. This graph shows the results of an anchoring efficiency test for a compression grip 14 using the aforementioned triangular coil 18 as a friction enhancing material in which there was used a PC wire strand 12.7 mm in diameter. The mark P in this graph indicates a specified breaking load (18,700 kg). Reference to this graph clearly shows that if the specified breaking force is undertaken by the compression grip 14 alone, a sleeve length of 50 to 60 mm is required, while about two thirds of the specified breaking load is undertaken by the compression grip 14 accordng to the structure of the present invention, and the sleeve length becomes about 20 mm, that is, the sleeve length is shortened to nearly one third as compared with the case of the use of the compression grip 14 alone.

Even in case the material and reduction area of the sleeve 16 of the compression grip 14 as well as the kind of friction enhancing material are changed, the relation between the sleeve length and the breaking load exhibits the same tendency as in the aforesaid graph qualitatively although it changes quantitatively. Therefore, in the structure of the present invention, by setting the length of the compression grip 14 at one half to one third of the length required for anchoring with the compression grip 14 alone, about two thirds of the breaking force is undertaken by the compression grip 14.

Figure 6:
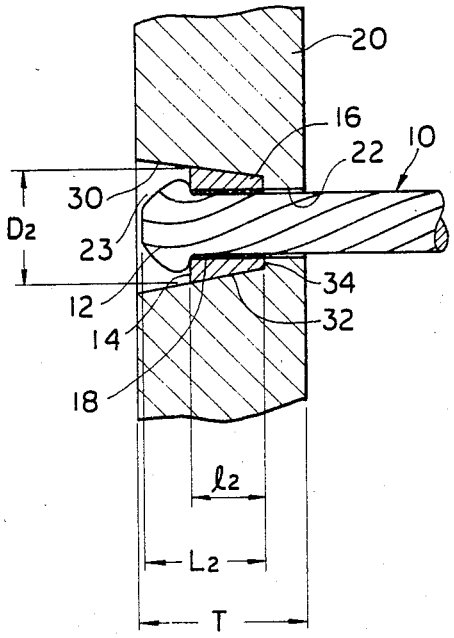
FIG. 6 is a sectional view of an anchorage according to an embodiment of the present invention.

Further, in order to miniaturize the size of the compression grip 14 with 100% of anchoring efficiency maintained, the outer circumference face of the sleeve 16 and the corresponding inner circumference face 30 of an enlarged space 23 adjacent to an anchoring hole 22 can be kept tapered as shown in FIG. 6.

In this anchoring structure, too, the load added to an anchorage by tensioning PC wire strand is borne by the above-mentioned enlarged head 12 and the compression grip 14. In addition, the compression grip 14 is set adjacent to the anchoring hole 22 in the bearing plate 20 with the tapered surface 30 of the compression grip 14 in contact with the corresponding tapered surface 32 of the enlarged space 23 in the bearing plate 20, thereby adding the tightening force to the PC wire strand 10 by wedge action at the time of tensioning and increasing the anchoring efficiency. Our experiments showed that the suitable angles of the above-mentioned surfaces 30 and 32 were between 5° and 15°. If the angles are smaller than the above figures, the compression grip 14 will slip out from the anchoring hole 22 of the bearing plate 20 and if the angles are larger than the above figures not enough tightening force for PC wire strand 10 will be gained. The longitudinal position of the end 34 of the enlarged space 23 shall be predetermined by experiments so that the desired tensioning force may be gained.

Figure 1:
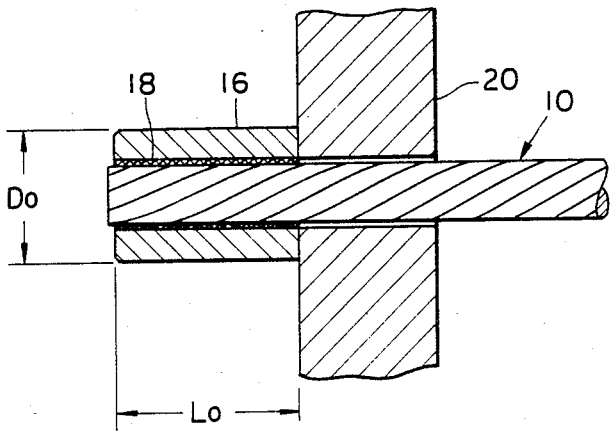
FIG. 1 PRIOR ART
FIG. 1 is a sectional view of an anchorage according to the prior art.

Thus, the length of compression grip 14 required to have enough anchoring efficiency is remarkably shortened compared with that of the prior art as shown in FIG. 1 and, even compared with that of FIG. 2, is shortened by the amount equivalent to the tightening force gained by wedge action. Further, this method has the advantages of the compression grip 14 and the enlarged head 12 being encased in the enlarged space 23 of the bearing plate 20 to be suited for embedding, and the thickness T of the bearing plate 20 being made thinner compared with that of the structure shown as T' in FIG. 2. In addition, in the case of the structure as shown in FIG. 2 one end surface of the sleeve 16 is required to have the receiving area for the load, and so a sleeve of larger thickness is needed. However, in this method as the tapered outer circumference surface 32 of the sleeve 16 bears the load, only enough thickness of the sleeve as to make the outer circumference surface 32 tapered is required, and the sleeve of smaller thickness is preferable in order to transmit the tightening force gained by wedge operation to the PC wire strand 10. Therefore, as the whole anchoring portions are miniaturized including the above mentioned enlarged space 23 in the bearing plate 20, the existence of weak portions in the bearing plate 20 is also avoided.

Described hereinbelow are the experimental data showing the effects of this invention.

Table 1 shows the sizes of anchorages to gain the required anchoring strength concerning the present inventions as shown in FIGS. 2 and 6 and the prior art as shown in FIG. 1, that is, the total lengths of anchorages $L_0$, $L_1$, $L_2$, the diameters of the sleeves $D_0$, $D_1$, $D_2$, and the lengths of the sleeves of the present inventions $\mathbf{1}_1$, $\mathbf{1}_2$ and of the prior art $L_0$ for PC wire strands of 9.3 mm and 12.7 mm in diameter to be required to meet the specified strength. The total lengths of the anchorages mean the length of the sleeve only with respect to the prior art, and as to the present invention such mean the lengths of the enlarged heads 12 plus those of the sleeves $L_1$ or $L_2$.

TABLE 1

| Diameter of PC wire strand | Total length of anchorages | | | Diameter of sleeves | | | Length of sleeves | | |
|---|---|---|---|---|---|---|---|---|---|
| | Prior art $L_0$ | FIG. 2 $L_1$ | FIG. 6 $L_2$ | Prior art $D_0$ | FIG. 2 $D_1$ | FIG. 6 $D_2$ | Prior art $L_0$ | FIG. 2 $l_1$ | FIG. 6 $l_2$ |
| 9.3 mm | 30 mm | 22 mm | 17 mm | 18.5 mm | 20 mm | 17.5 mm | 30 mm | 15 mm | 10 mm |
| 12.7 mm | 55 | 30 | 25 | 25.5 | 27 | 24 | 55 | 20 | 15 |

As understood from the test results, while in the prior art as shown in FIG. 1 the length $L_0$ of the sleeve 16 needs to be three to four times the diameter of the PC wire strand; in the present inventions the lengths of the sleeves $l_1$ and $l_2$ are shortened to be one (1) to one and a half (1.5) times the diameters of PC wire strands and the total lengths of the anchorages $L_1$ and $L_2$ including the enlarged heads are also miniaturized to about two times the diameters of PC wire strands. By using 9.3 mm diameter PC wire strands manufactured in accordance with JIS G 3536-1971 with the specified breaking strength of min. 9,050 kg, efficiencies were tested in three cases, that is, the anchorage with the enlarged head only and those of FIGS. 2 and 6 with the sizes of anchorages as shown in Table 1. Anchoring efficiencies are shown by the ratios of the breaking strengths of PC wire strands in each case to the specified breaking strength as mentioned above. The test results show that anchoring efficiencies are about 60% in the case of the enlarged head only, and about 100% and 105% respectively in the cases of FIGS. 2 and 6.

Figure 7:
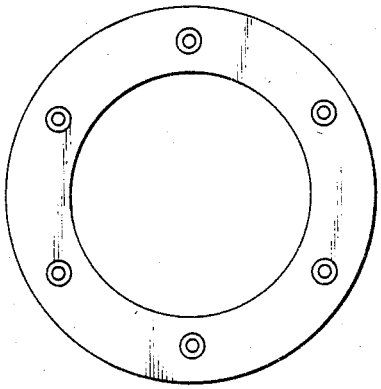
FIG. 7 is an end view of prestressed concrete pile according to an embodiment of the present invention.
Figure 8:
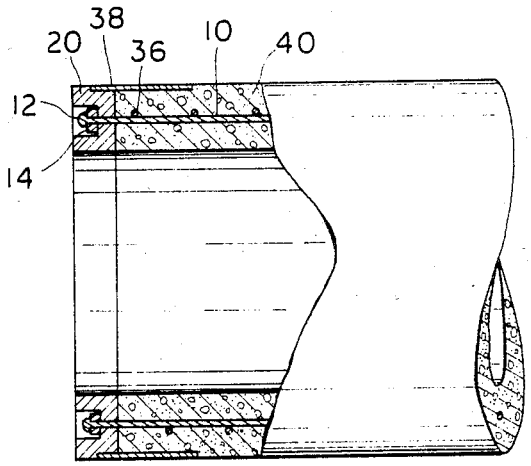
FIG. 8 is a partially sectional view of prestressed concrete pile according to an embodiment of the present invention.

FIGS. 7 and 8 show an embodiment where a plurality of anchorages according to this invention as shown in FIG. 2 are applied to a prestressed concrete pile. Numeral 36 denotes spirally shaped reinforce wire, numeral, 38 a reinforcing band and numeral 40 a body of a prestressed concrete pile. A bearing plate 20 compresses a plurality of anchoring holes with enlarged spaces adjacent to them forming a perforated bearing plate, and each enlarged space adjacent to the anchoring hole is adapted for receiving the corresponding end of PC wire strands with enlarged heads and anchoring members.

Figure 9:
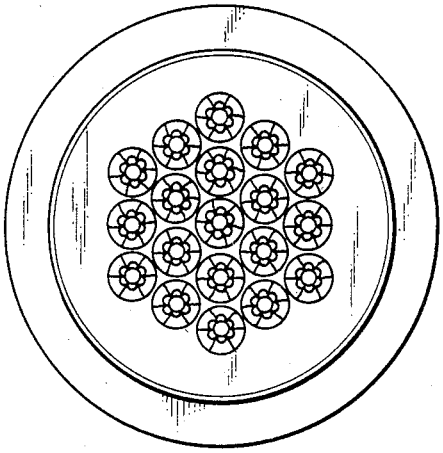
FIG. 9 is an end view of an anchorage for multi-strand cable according to an embodiment of the present invention.
Figure 10:
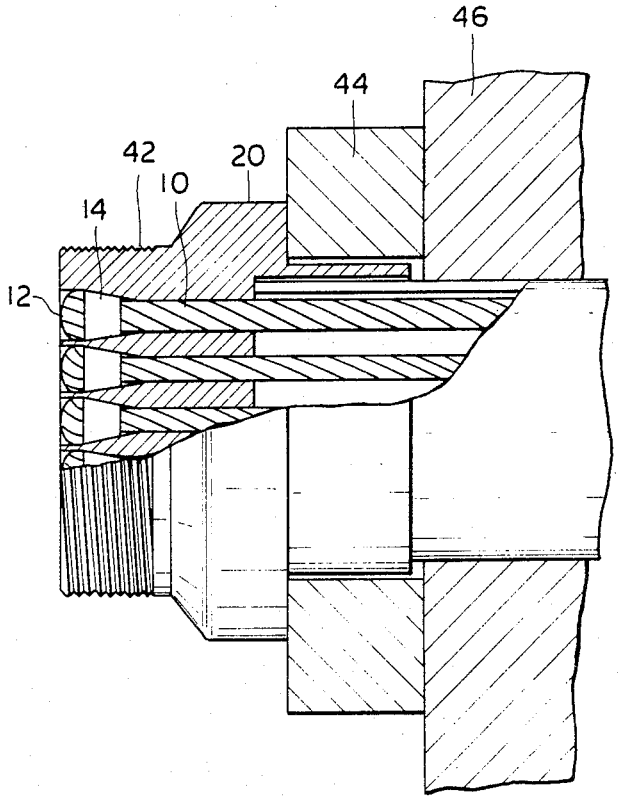
FIG. 10 is a partially sectional view of the end portion of an anchorage cable according to an embodiment of the present invention.

FIGS. 9 and 10 show another embodiment where a plurality of anchorages according to this invention as shown in FIG. 6 are applied to a multi-strand cable. Numeral 42 denotes a threaded portion for coupling, numeral 44 a bearing plate and numeral 46 a receiving concrete structure. A bearing plate 20 comprises a plurality of anchoring holes with the enlarged space adjacent them forming a perforated bearing plate, and the inner circumference surface of said enlarged space is tapered so as to receive the corresponding tapered sleeve.

Thus, according to the anchoring structure of the present invention, the breaking force is undertaken by both the compression grip (anchoring member) and the enlarged head portion, and the length of the compression grip is shortened to about one third to one half as compared with the case where anchoring is effected with the compression grip alone, so that a less expensive and smaller-sized anchoring portion is obtainable while attaining 100% anchoring efficiency. According to this anchoring structure, moreover, it becomes possible to use PC wire strands in place of conventional PC wire or PC steel bar for post-tensioning prestressed concrete structures of an industrially produced prestressed concrete member wherein the anchor portion is used in an embedded state. As a result, various effects are obtained. First, saving of PC steel material is attained; that is, the quantity of PC steel material is, in principle, proportional to its strength, so if for example a deformed PC steel bar (tensile strength: 145 $kg/mm^2$) is substituted by the PC wire strand (tensile strength: 190 $kg/mm^2$), about 30% in material can be saved because of an increase in strength of ($190/145 \approx 1.3$). Moreover, by using a high strength PC wire strand, the number of PC wires used can be decreased, so that the time and labor required for cutting, wiring and similar work can be significantly reduced and working efficiency is improved. Furthermore, it becomes possible to introduce a high load of prestressing which is not attained with PC wire or a PC steel bar.

Obviously, numerous modifications and variations of the present invention are possible in light of the above teachings. It is therefore to be understood that within the scope of the appended claims, the invention may be practiced otherwise than as specifically described herein.

What is claimed is:

1. An anchorage for PC wire strands, comprising:

an enlarged head portion formed by heading a terminal end of a PC wire strand; and a single anchoring member held in pressure contact with a portion of said PC wire strand in a position near said terminal end and having a side end held in close contact with said enlarged head portion, said anchoring member being from 1.5 to 2.0 times a diameter of said PC wire strand and a combined length of said enlarged head portion and said anchoring member being from 2.0 to 2.5 times said diameter of said PC wire strand wherein said anchoring member further comprises a compression grip having a sleeve and a friction enchancing member separate from said sleeve and positioned between said sleeve and said PC wire strand.

2. An anchorage for PC wire strands as set forth in claim 1, wherein said friction enhancing member further comprises a wire coil.

3. An anchorage for PC wire strand as set forth in claim 1, further comprising a bearing plate operatively associated with said anchoring member and which has a plurality of anchoring holes formed therein with enlarged spaces adjacent thereto, forming a perforated bearing plate, each enlarged space of said anchoring holes receiving corresponding PC wire strands with said enlarged head portion and said anchoring member.

4. An anchorage for PC wire strands as set forth in claim 3, wherein said anchoring member has a tapered outer circumference surface with an angle between 5° and 15°, and is received by a corresponding enlarged space with tapered inner surface adjacent to an anchoring hole of said anchoring holes of said bearing plate.

* * * * *